US005117852A

United States Patent [19]

Bryant

[11] Patent Number: 5,117,852

[45] Date of Patent: Jun. 2, 1992

[54] FREE-STANDING FRAME AND DOME TENT USING SAME

[75] Inventor: Charles D. Bryant, Rockport, Me.

[73] Assignee: Moss, Inc., Camden, Me.

[21] Appl. No.: 503,630

[22] Filed: Apr. 3, 1990

[51] Int. Cl.[5] ..... E04H 15/40

[52] U.S. Cl. ..... 135/104; 52/81

[58] Field of Search ..... 52/DIG. 10, 80, 81; 135/104

[56] References Cited

U.S. PATENT DOCUMENTS

| | | | |
|---|---|---|---|
| 3,968,808 | 7/1976 | Zeigler | 52/81 |
| 4,092,810 | 6/1978 | Sumner | 52/81 |
| 4,182,086 | 1/1980 | Crooks | 52/81 |
| 4,265,259 | 5/1981 | Gillis | 135/104 |
| 4,858,635 | 8/1989 | Eppenbach | 135/104 |
| 4,945,584 | 8/1990 | La Mantia | 135/104 |

*Primary Examiner*—Henry E. Raduazo

*Attorney, Agent, or Firm*—Iandiorio & Dingman

[57] ABSTRACT

A free-standing structure having n sides defining n origins where n is greater than two, including a frame having n arch members, two paired arch members fixed at each of n origins; each arch member extending from its origin, across its paired arch member to a different origin across from its initial origin, the arch members forming an n-sided polygon at the top center of the structure; the paired arch members crossing each other on the far side of the polygon relative to the initial origin, the crossing occurring on an axis of symmetry extending through the initial origin and the top center of the structure; and means for securing together the paired arch members at the origins.

11 Claims, 4 Drawing Sheets

FREE-STANDING FRAME AND DOME TENT USING SAME

FIELD OF INVENTION

This invention relates to an improved symmetrical free-standing frame for a domed tent or like structure, and more particularly to a domed tent using that frame.

BACKGROUND OF INVENTION

Conventional dome tents employ a plurality of struts or poles which arch over to form a framework to support the fabric body. The framework is generally asymmetrical and the poles are of different sizes, which makes the tent more expensive to manufacture and more difficult to assemble. Coding of the poles and body and more explicit instructions are required. The body fabric extends over large panels of various geometric shapes so that these tents are susceptible to the adverse effects of wind and snow loading. In addition, the various poles cross over the top center of the tent and prevent the placement of a vent flap for exhausting the tent interior. The side walls of these tents are inclined so that they substantially limit the useable volume at the perimeter of the tent.

SUMMARY OF INVENTION

It is therefore an object of this invention to provide an improved frame for a dome tent or similar structure.

It is a further object of this invention to provide such an improved domed tent.

It is a further object of this invention to provide such an improved frame which is stronger than similar frames of like weight and size.

It is a further object of this invention to provide such an improved frame which is less expensive to make and easier to assemble.

It is a further object of this invention to provide such an improved frame in which all the poles of the frame are of equal length.

It is a further object of this invention to provide such an improved frame which increases the number of pole crossings and subdivisions including triangular and polygonal subdivisions for increased strength and rigidity.

It is a further object of this invention to provide such an improved frame in which the poles traverse the tent about the top center, leaving ample center space for a vent flap.

It is a further object of this invention to provide such a frame in which the structure is more generally spherical in shape with steeper side walls and more useable space per unit floor area.

The invention results from the realization that a truly strong, lightweight, rigid, free-standing frame can be effected in an n-sided frame with n origins, where n is greater than two, by securing n such members together in pairs at the origins and extending them to two different origins across from the initial origin so that they cross on the other side of the top center of the frame on an axis of symmetry which extends from the initial origin through the top center and the crossing occurs on the far side of the top center from the initial origin.

SUMMARY OF INVENTION: II

This invention features a free-standing structure having n sides defining n origins, where n is greater than two. There is a frame having n arch members. Two paired arch members are fixed at each of n origins. Each arch member extends from its origin across its paired arch member to a different origin across from its initial origin. The arch members form an n-sided polygon at the top of the n-sided structure. The paired arch members cross each other on the far side of the polygon relative to the initial origin. The crossing occurs on an axis of symmetry extending through the initial origin and the top center of the structure. There are also means for securing together the paired arch members at the origins.

In a preferred embodiment, the n sides form an n-sided equilateral polygon. The arch members are equal in length. The polygon at the top center is an n-sided equilateral polygon. The arch members generate a plurality of subdivisions including 2n triangular subdivisions and n triangular subdivisions. The arch members also generate n polygonal subdivisions where $n>3$. The structure may also include a cover mounted on the arch members for tensioning the frame and rigidifying the structure. The means for securing may include tunnels in the cover for receiving the arch members and may further include tunnels for receiving the ends of the paired arch members at the origins themselves. The securing means may also include a loop which may be carried by the cover for surrounding and binding the paired arch members.

In a preferred embodiment the invention relates to a free-standing dome tent having n sides defining n origins, where $n>2$, and includes a frame and a cover mounted on the frame.

DISCLOSURE OF PREFERRED EMBODIMENT

Other objects, features and advantages will occur to those skilled in the art from the following description of a preferred embodiment and the accompanying drawings, in which.

Figure 1:
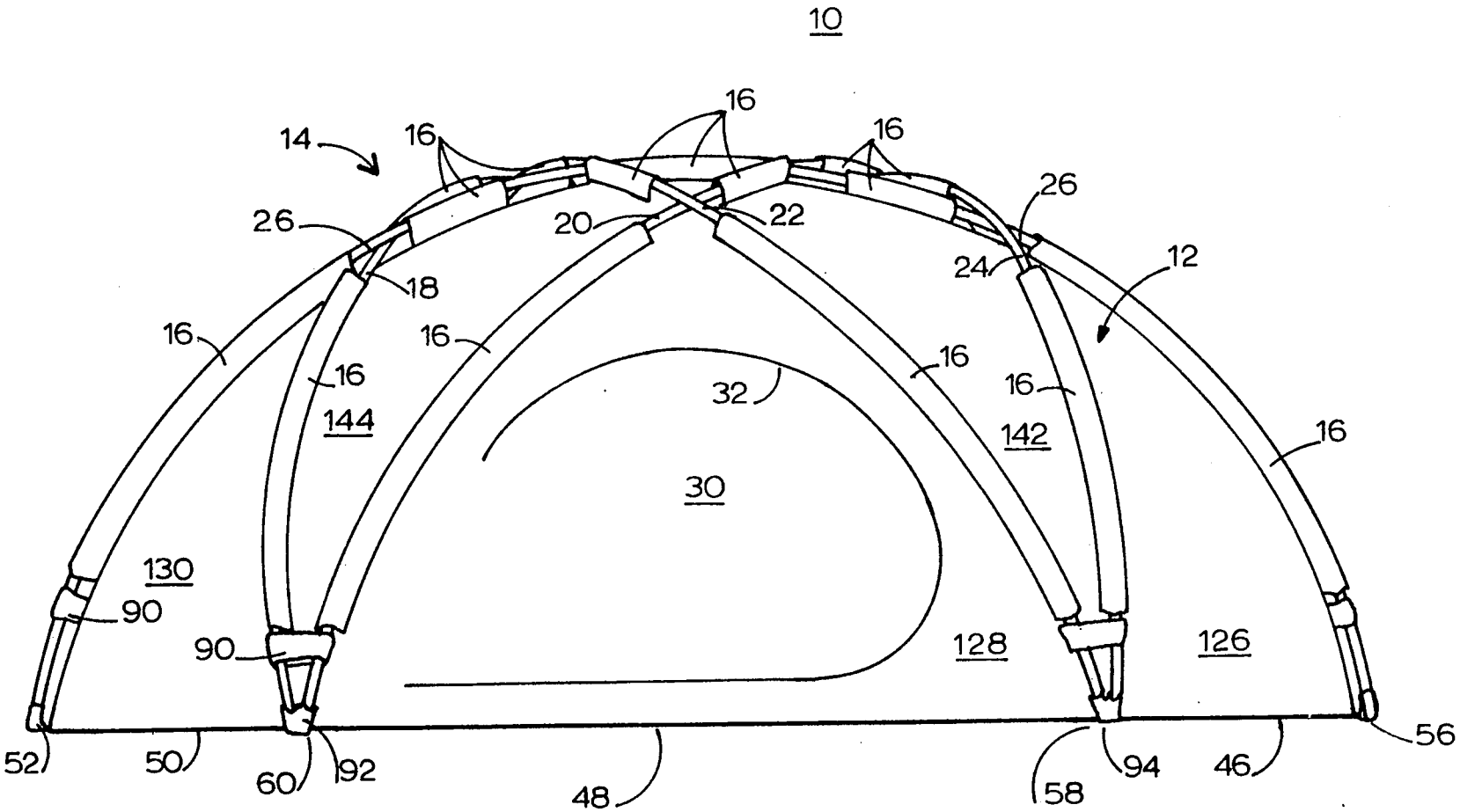
FIG. 1 is a front elevational view of a dome tent including a free-standing frame according to this invention.
Figure 2:
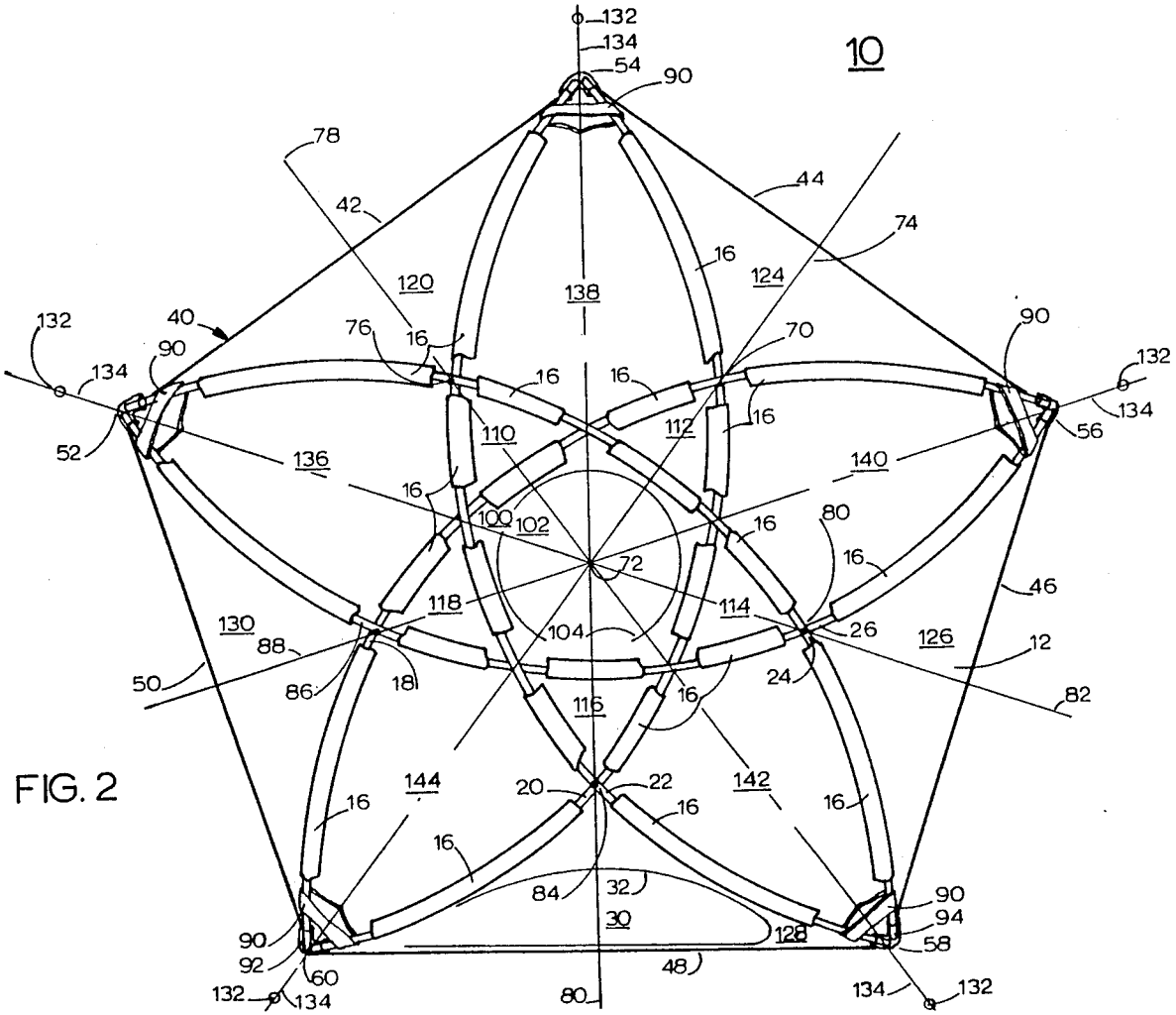
FIG. 2 is a top plan view of the dome tent of FIG. 1.

There is shown in FIG. 1 a dome tent 10 including a fabric cover or body 12 which is mounted on frame 14 by fabric tunnels 16 which are integral with cover 12 and receive the arch members 18, 20, 22, 24, and 26. A door flap 30 is provided in the front of dome tent 10 and is operated by a zipper 32 installed in cover 12. The construction of dome tent 10 and supporting frame 14 can be seen best by referring to FIGS. 1 and 2 jointly. FIG. 2 demonstrates that dome tent 10 is an n-sided structure where n is greater than two and in this case is equal to five, so that tent 10 has the shape of a five-sided polygon, or pentagon, and its perimeter 40 includes five sides 42, 44, 46, 48 and 50, which define five apices or origins 52, 54, 56, 58 and 60. The five arch members 18, 20, 22, 24 and 26 combine to form frame 14.

Each pair of arch members is fixed at one of the origins and extends from its origin across its paired arch member to a different origin across from its initial origin. Thus arch members 18 and 20 meet at origin or apex 60 and then extend up and around through various tunnels 16 and cross at point 70. Point 70 is on the far side of top center point 72 relative to origin 60 and is positioned along an axis of symmetry 74 which extends through origin 60 and center point 72. Arch member 18 then continues down to origin 56 while arch member 20 continues down to origin 54. In a similar manner, arch members 22 and 24 meet at origin 58, then bow upwardly through various tunnels 16 until they cross at point 76 on the opposite side of center point 72, and along axis of symmetry 78. Arch member 22 then continues on to origin 54, where it joins with arch member 20. Arch member 22 continues along to origin 52, where it joins with arch member 26.

In a similar manner, arch members 26 and 24 can be seen to meet at origin 52, then extend up and over the tent to cross at intersection point 80 on the far side of center point 72 and along the axis of symmetry 82. Arch members 20 and 22 can be seen to meet at origin 54 and extend up and over and cross at intersection 84 along axis of symmetry 86. Arch members 26 and 18 extend from origin 56 to cross each other at intersection 86 along axis of symmetry 88. Arch members 18–26 may be simply steel or aluminum tubing, all of which are exactly the same length and which are generally straight when stored and become arched when installed and erected in frame 14. Each pair of the arch members should be secured in some fashion so that they properly meet at their respective origins. This can be done by means of fabric loops 90, five of which are shown, one proximate each origin in FIG. 2. Alternatively, a terminal fabric tunnel 92 may be used as shown in phantom at origin 60, or a plastic elbow 94 may be used such as shown in phantom at origin 58.

As a consequence of the arrangement of the arch members in frame 14, there is a polygonal center area 100 which is bounded by the five arch members that leave the center area around center point 72 open so that a vent flap 102 can be installed there to be operated by zipper 104 to exhaust the interior of the tent. Another consequence of this construction is that there are a large number of areas or subdivisions defined by the crisscrossing arch members that strengthen and rigidify the structure. For example, since in the n-sided structure of FIGS. 1 and 2 n is equal to five, there are five triangular subdivisions 110, 112, 114, 116 and 118 immediately surrounding polygon 100, as well as five more triangular subdivisions 120, 124, 126, 128 and 130, which extend along the five sides 42, 44, 46, 48 and 50 of perimeter 40. The five stakes 132 connected to the area of the tent proximate the five origins by means of lines 134 keep the sides taut and enhance the structural contribution of those triangular subdivisions. In addition, there are five other subdivisions 136, 138, 140, 142 and 144 which are polygons of a sort. Thus for an n-sided structure there are 2n triangular subdivisions and n polygonal subdivisions which further enhance and increase the strength and rigidity of the overall structure. The polygon formed by perimeter 40 as well as polygon 40 are equilateral polygons, that is, each of their sides is equal in length, and all of the arch members are equal in length as well.

Figure 3:
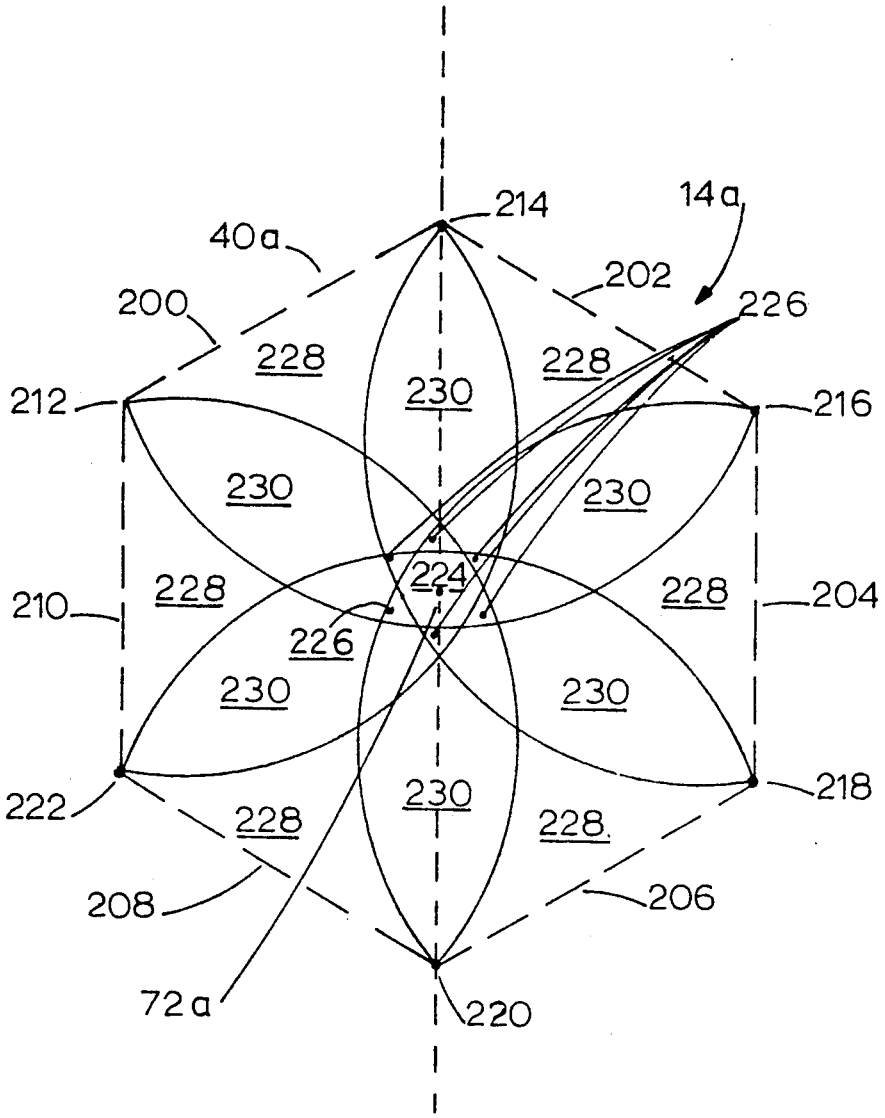
FIG. 3 is a schematic view similar to FIG. 3 of a six-sided frame.
Figure 4:
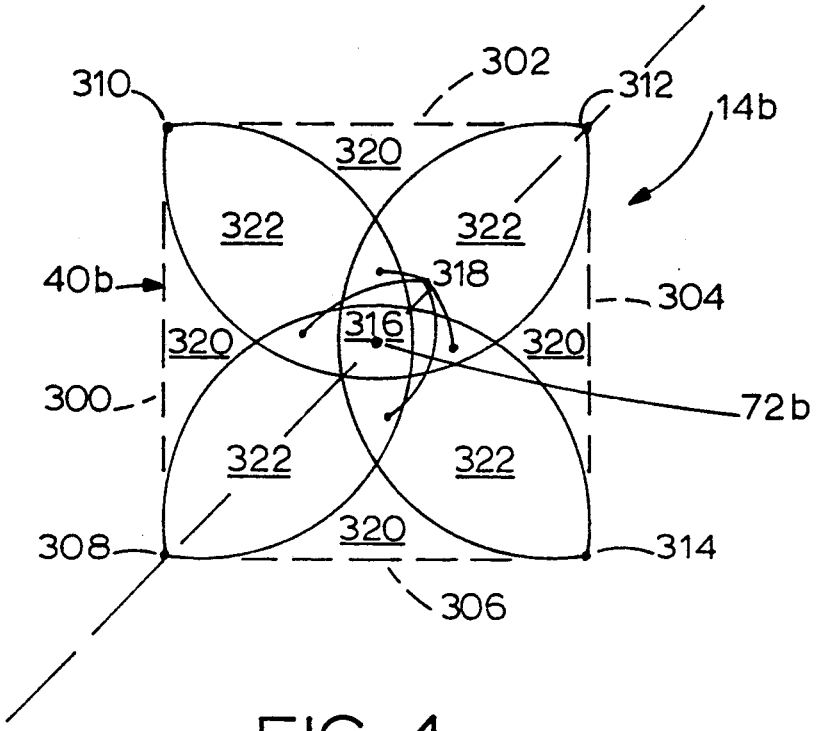
FIG. 4 is a schematic view similar to FIG. 3 of a four-sided frame.
Figure 5:
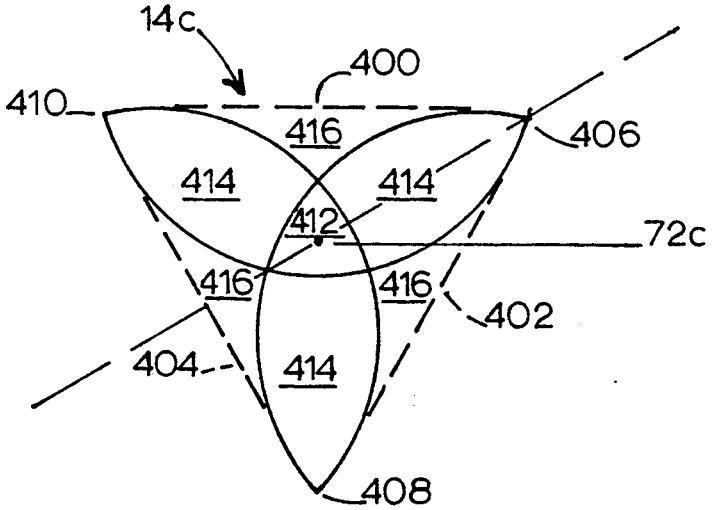
FIG. 5 is a view similar to FIG. 3 of a three-sided frame.

That the same construction can be applied to an even-sided polygon with a larger or smaller n can be seen from FIGS. 3, 4 and 5. FIG. 3 schematically depicts a frame 14*a* having a perimeter 40*a* with six sides 200, 202, 204, 206, 208 and 210, and six origins 212, 214, 216, 218, 220 and 222. The center area 224 is then of course a six-sided polygon and is surrounded by six triangular subdivisions 226 which complement the six triangular subdivisions 228 located along perimeter 40*a*. Thus there are 2n or twelve triangular subdivisions in FIG. 3, and n or six polygonal subdivisions 230 in addition to central polygon 224.

In frame 14*b*, FIG. 4, n is equal to four, so perimeter 40*b* has four sides 300, 302 304 and 306, which define four original 308, 310, 312, and 314. Central polygon 316 thus becomes a four-sided figure surrounded by four interior triangles 318 which complement four external triangular subdivisions 320. There are four polygonal subdivisions 322. Frame 14 may be constituted by as few as three arch members when n=3 as shown in FIG. 5, where perimeter 14*c* includes three sides 400, 402, 404, which define three origins 406, 408 and 410. In this case again, the central polygon 412 is an n-sided or three-sided polygon, and there will be 2n triangles, the three interior triangles 414 and the three exterior triangles 416, but in this singular case where n=3, there are no additional n polygonal subdivisions.

Although specific features of the invention are shown in some drawings and not others, this is for convenience only as each feature may be combined with any or all of the other features in accordance with the invention, Other embodiments will occur to those skilled in the art and are within the following claims:

What is claimed is:

1. A free-standing structure having a perimeter and n sides defining n origins on the perimeter, where n is greater than two; a frame having n arch members, two said arch members paired at each of n origins; each such member extending from an initial origin across its paired arch member to an origin different from its pair and across from its initial origin, said arch members forming a self-supporting structure with an n-sided polygon at the top center of the structure; said paired arch members crossing each other on the far side of said polygon relative to the initial origin, said crossing occurring on an axis of symmetry extending through the initial origin and the top center of the structure; and means for securing together said pair arch members at the origins.

2. The free-standing structure of claim 1 in which said n sides form an n-sided equilateral polygon.

3. The free-standing structure of claim 1 in which said arch members are equal in length.

4. The free-standing structure of claim 1 in which said polygon at the top center is an n-sided equilateral polygon.

5. The free-standing structure of claim 1 in which said arch members generate a plurality of subdivisions including 2n triangular subdivisions.

6. The free-standing structure of claim 5 in which said arch members generate n polygonal subdivisions where n is greater than three.

7. The free-standing structure of claim 1 in which said structure further includes a cover mounted on said arch members for tensioning said frame and rigidifying said structure.

8. The free-standing structure of claim 1 in which said means for securing includes tunnels in said cover for receiving said arch members.

9. The free-standing structure of claim 8 in which said means for securing includes tunnels for receiving the ends of said paired arch members at said origins.

10. The free-standing structure of claim 7 in which said means for securing includes a loop carried by said cover for surrounding and binding said arch members.

11. A free-standing dome tent having a perimeter and n sides defining n origins on the perimeter where n is greater than two, comprising:

a frame having n arch members, two said arch members paired at each of said n origins; each member extending from an initial origins across its paired arch member to an origin different from its pair and across from its initial origin, said arch members forming a self-supporting structure with an n-sided polygon at the top center of the tent; said paired arch members crossing each other in the far side of said polygon relative to the initial origin, said crossing occurring on an axis of symmetry extending through the initial origin and the top center of the tent; and a cover mounted on said arch members for securing and tensioning said frame and rigidifying said tent.

* * * * *